US008581492B2

(12) United States Patent
Fudala et al.

(10) Patent No.: US 8,581,492 B2
(45) Date of Patent: Nov. 12, 2013

(54) ELECTRIC INCANDESCENT LAMP FOR VEHICLE HEADLIGHTS WITH NEW FILAMENT GEOMETRY

(75) Inventors: Agnes Mezeine Fudala, Budapest (HU); Zoltan Bako, Budapest (HU)

(73) Assignee: General Electric Company, Schenectady, NY (US)

( * ) Notice: Subject to any disclaimer, the term of this patent is extended or adjusted under 35 U.S.C. 154(b) by 327 days.

(21) Appl. No.: 12/908,403

(22) Filed: Oct. 20, 2010

(65) Prior Publication Data

US 2012/0098407 A1 Apr. 26, 2012

(51) Int. Cl.
*H01K 1/50* (2006.01)

(52) U.S. Cl.
USPC ..... 313/578; 313/271

(58) Field of Classification Search
USPC ..... 313/271–279, 315–316, 578, 547
See application file for complete search history.

(56) References Cited

U.S. PATENT DOCUMENTS

| | | | | | |
|---|---|---|---|---|---|
| 1,632,769 | A | * | 6/1927 | Severin | 313/344 |
| 1,716,645 | A | * | 6/1929 | Kuen | 313/301 |
| 3,538,374 | A | * | 11/1970 | Kane | 313/273 |
| 4,598,342 | A | * | 7/1986 | English et al. | 362/213 |
| 4,959,585 | A | * | 9/1990 | Hoegler et al. | 313/271 |
| 5,508,587 | A | | 4/1996 | Williams et al. | |
| 5,686,794 | A | * | 11/1997 | Streppel et al. | 313/579 |
| 6,469,426 | B1 | | 10/2002 | Hurst et al. | |
| 6,677,699 | B1 | | 1/2004 | Kuti | |
| 6,690,103 | B1 | * | 2/2004 | Uke | 313/344 |
| 7,423,370 | B2 | | 9/2008 | Itaya et al. | |
| 7,456,558 | B2 | | 11/2008 | Buhler et al. | |
| 2003/0001475 | A1 | | 1/2003 | Halpin | |
| 2005/0218804 | A1 | | 10/2005 | Goijaerts | |
| 2006/0038471 | A1 | | 2/2006 | Buhler et al. | |
| 2007/0108901 | A1 | | 5/2007 | Goijaerts | |
| 2008/0018219 | A1 | | 1/2008 | Li et al. | |

FOREIGN PATENT DOCUMENTS

| | | | |
|---|---|---|---|
| DE | 10 2006 020580 | A1 | 11/2007 |
| EP | 0533478 | A1 | 3/1993 |
| JP | 5 347152 | A | 12/1993 |
| WO | WO 01/91161 | A1 | 11/2001 |

OTHER PUBLICATIONS

PCT/US2011/052433—Invitation to Pay Additional Fees and Partial Search Report, mailed Dec. 20, 2011.
PCT Search Report and Written Opinion dated Mar. 30, 2012 from corresponding Application No. PCT/US2011/052433.

* cited by examiner

*Primary Examiner* — Anne Hines
*Assistant Examiner* — Jose M Diaz
(74) *Attorney, Agent, or Firm* — Fay Sharpe LLP

(57) ABSTRACT

A filament coil for an incandescent lamp assembly is provided. The filament coil includes a helical winding extending generally along a longitudinal axis between a first end and a second end. The filament coil further includes a winding having a first pitch ratio at the first and second ends, and a different, second pitch ratio along an intermediate portion located between the first and second ends.

17 Claims, 3 Drawing Sheets

ELECTRIC INCANDESCENT LAMP FOR VEHICLE HEADLIGHTS WITH NEW FILAMENT GEOMETRY

BACKGROUND OF THE DISCLOSURE

The present disclosure relates to an incandescent lamp, more specifically, to a filament coil structure with a different geometry. The filament coil structure finds particular application in vehicle headlamps or headlights, although it will be appreciated that selected aspects may find application in related applications encountering issues of increasing contrast of the cut-off region.

U.S. Publication No. 2006/0038471 and U.S. Pat. No. 7,456,558 disclose incandescent lamp filaments having different pitch ratios located at opposite ends of the filament in order to increase the luminance at the light/dark boundary of the low beam. The pitch ratio is represented by the following equation:

$$PR=h/d$$

wherein:

PR=Pitch Ratio d=Diameter of filament wire h=Distance between adjacent coil turn axis However, at the ends of the incandescent filament close to the base, the pitch ratio is higher resulting in less light onto roadways. Other incandescent filament technologies have outside diameters increase continuously from a minimum value at a first end of the filament to a maximum value at the second filament end resulting in a less compact vehicle headlamp.

Even in light of recent advances, the industry continues to lack a filament with useful geometry for achieving high luminance in the region of the light/dark boundary of the low beam vehicle headlight where good illumination is desired.

SUMMARY OF THE DISCLOSURE

In an exemplary embodiment, a filament coil for an incandescent lamp assembly includes a helical winding extending generally along a longitudinal axis between a first end and a second end. The winding has a first pitch ratio at the first and second ends, and a different, second pitch ratio along an intermediate portion located between the first and second ends.

In one embodiment of the disclosure, a first helical pitch is less than a second helical pitch.

In still another embodiment of the disclosure, the coil has substantially the same diameter at the first and second ends, and a smaller diameter along the intermediate portion.

A method of forming a filament coil for an incandescent lamp includes supplying a helical winding having an intermediate portion located between first and second ends along a longitudinal axis. The method further includes providing a first pitch ratio at the first and second ends, and a different, second pitch ratio at the intermediate portion.

A primary benefit realized by the filament coil for an incandescent lamp is the ability to increase the maximum luminance of the vehicle headlight around a hot-spot region.

Another benefit realized by the filament coil for an incandescent lamp is the ability to increase the maximum luminance of the vehicle headlight by changing the filament geometry.

Still another benefit realized by the filament coil for an incandescent lamp is the ability to sell new competitive products in the automotive aftermarket segments with an increased luminance and without having to replace an entire headlamp assembly.

Still other features and benefits of the filament coil for an incandescent lamp will become more apparent from reading and understanding the following detailed description.

DETAILED DESCRIPTION OF THE PREFERRED EMBODIMENTS

The current inventive filament coil achieves higher luminance in vehicle headlamps or headlights by changing the geometry of the coil in a manner differently compared to current technology. In one exemplary embodiment, the filament has higher pitch ratios at the ends and a lower pitch ratio in the middle or intermediate region between the ends in order to allow for an increase in luminance of the vehicle headlight. This is due to the filament having uniform interspace between two adjacent turns in the middle. Further, the filament has continuously increasing pitch or pitch ratios from the intermediate region in the direction of the two ends of the filament.

In another exemplary embodiment, the filament has an increased diameter at both ends and a smaller diameter in the middle or intermediate region between the ends in order to increase the maximum luminance of the vehicle headlight. Thus, the filament preferably has a uniform filament diameter in the middle region with a continuously increasing diameter from the middle region in the direction of the two ends of the filament. In this embodiment, either the filament pitch ratio can be varied in a similar way as the first embodiment or the filament can have a uniform spacing between two adjacent full turns. In particular, the embodiments of the present disclosure are suitable for lamps having axially or transversely aligned filaments.

Figure 1:
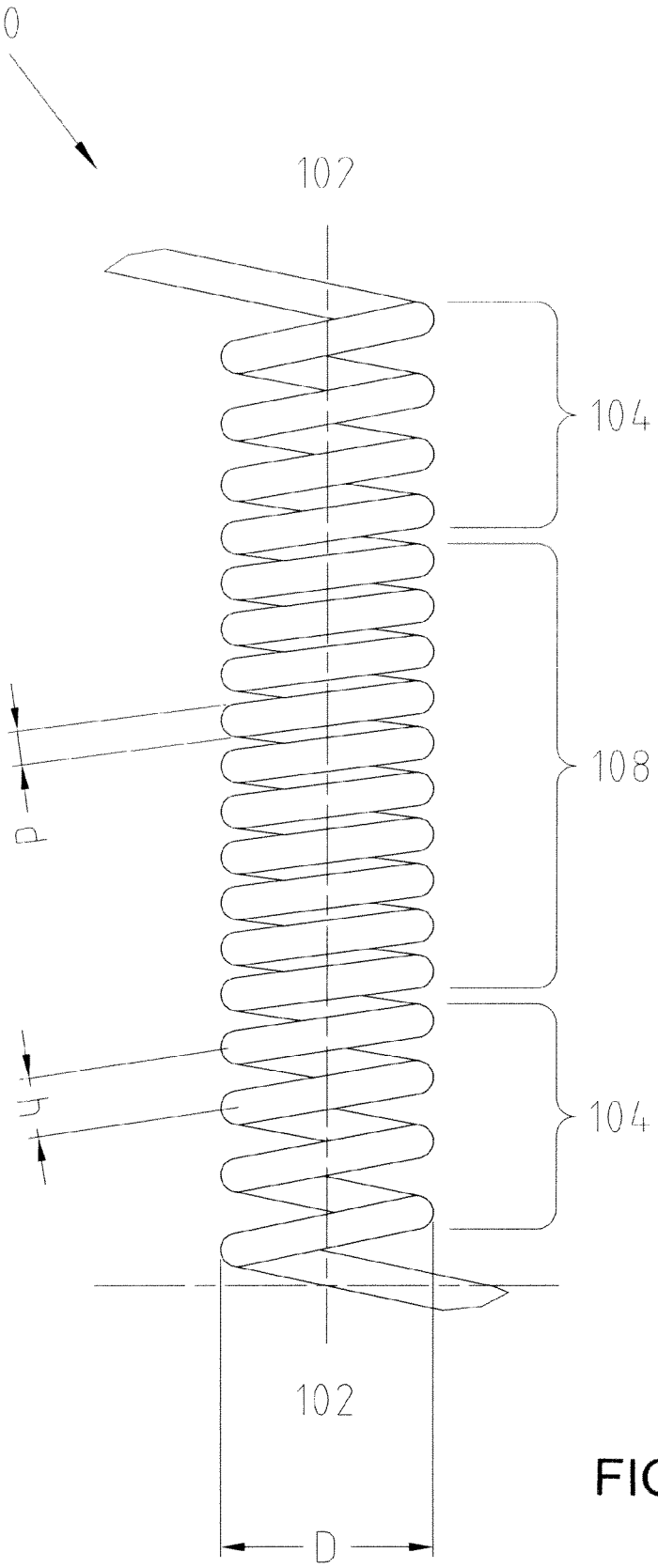
FIG. 1 is an elevational view of a filament coil in accordance with a first embodiment.
Figure 2:
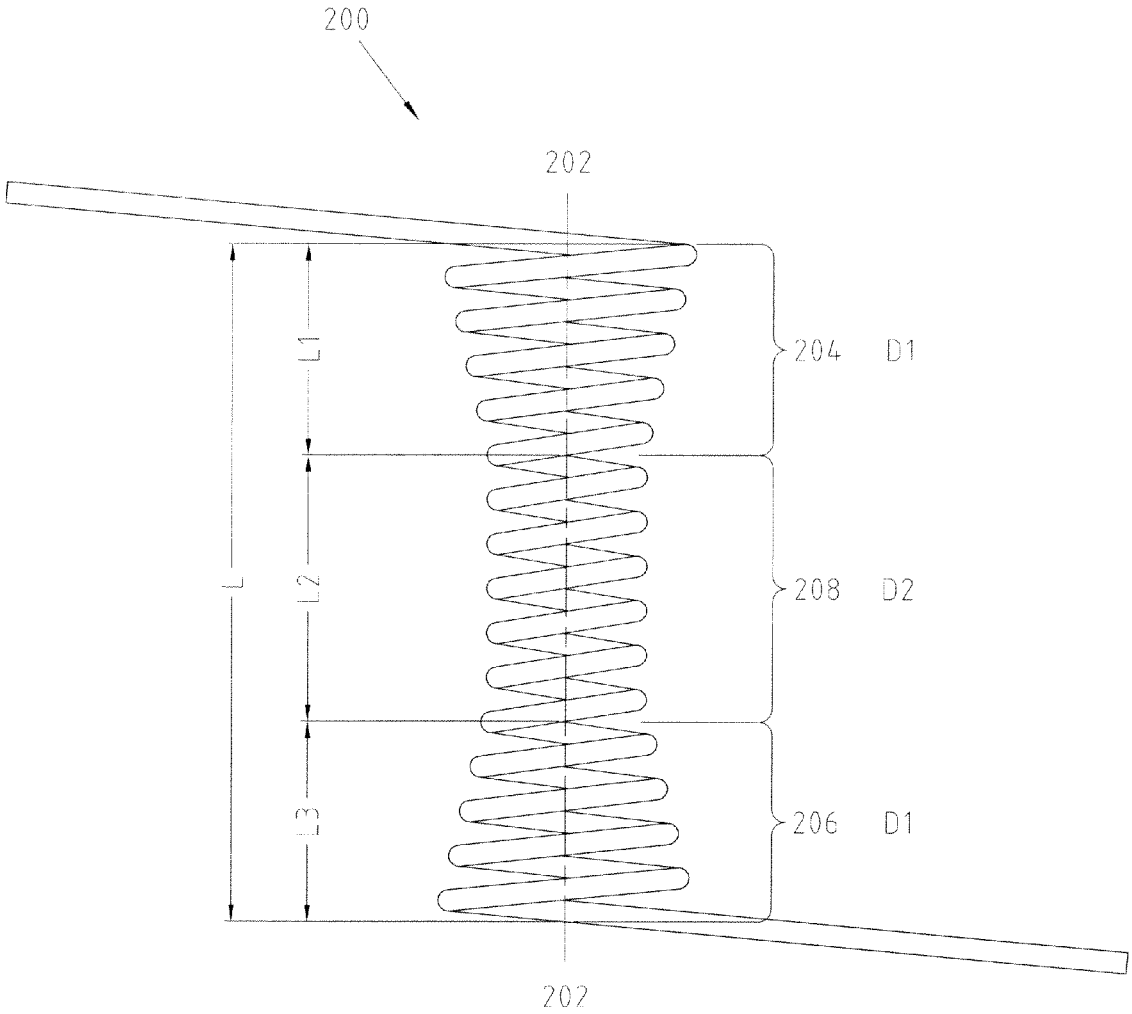
FIG. 2 is an elevational view of a filament coil in accordance with a second embodiment.

First and second exemplary filament coils 100, 200 of the present disclosure are illustrated in FIGS. 1 and 2, respectively. The filament coils 100 200 are, for example, tungsten wire. The filament wire may be of any suitable cross-section, although commonly used cross-sections of filament coils are typically circular, elliptical, square, or rectangular.

The filament coil 100 of the first embodiment (FIG. 1) includes a helical winding extending generally along a longitudinal axis 102 between a first end 104 and second end 106. The helical winding has a first pitch ratio at the first and second ends 104, 106. A different, second pitch ratio is provided along an intermediate region or middle portion 108 between the first and second ends 104, 106. Using the formula for pitch ratio enumerated above (PR=h/d), the pitch ratio for the first and second ends 104, 106 for an exemplary embodiment can be, for example, 2.2 and generally between 1.8-2.5. The pitch ratio for the intermediate portion 108 for an exemplary embodiment can be, for example, 1.4 and generally between 1.1-1.7. Of course, it will be understood by one skilled in the art that these ranges are exemplary only and have resulted in increased luminance over prior arrangements.

The first helical pitch is less turns per inch (tpi) than the second helical pitch. The first helical pitch located at the first and second ends 104, 106 for an exemplary embodiment, for example, can be at least 45 turns per inch (tpi), and generally less than about 70 turns per inch (tpi), e.g., about 60 turns per inch (tpi). The second helical pitch located at the intermediate portion 108 for an exemplary embodiment, for example, can be at least about 50 turns per inch (tpi), and generally about 100 turns per inch (tpi), e.g., about 70 turns per inch (tpi). The exemplary filament coil 100 has substantially the same diameter D at the first and second ends 104, 106, and along the intermediate portion 108. The diameter D for an exemplary embodiment, for example, can be 1.1 mm, and generally about 1.0-1.3 mm although one skilled in the art will appreciate that other dimensions can be used without departing from the scope and intent of the present disclosure.

A side view of a filament coil 200 of the second exemplary embodiment is illustrated in FIG. 2. The filament coil 200 is a helical winding extending generally along the longitudinal axis 202 between a first end 204 and second end 206. A different, second pitch ratio is located along an intermediate portion 208 between the first and second ends 204, 206. The first and second pitch ratios specifically result from at least different diameters at the ends relative to the intermediate region. In the illustrated embodiment, the diameter progressively increases toward each and/or the filament coil proceeds axially from the intermediate region 208. That is, in FIG. 2 the filament coil 200 has a substantially constant diameter $D_2$ along the axial length $L_2$ to define a pitch ratio 200 that is different than the pitch ratios 204, 206 along axial extent $L_1$, $L_3$ at the first and second ends. The first end, second end, and intermediate portion 204, 206, 208, respectively, each define about one-third $L_1$, $L_2$, $L_3$ of the total length L of the exemplary filament coil 200 along the longitudinal axis 202.

Figure 3:
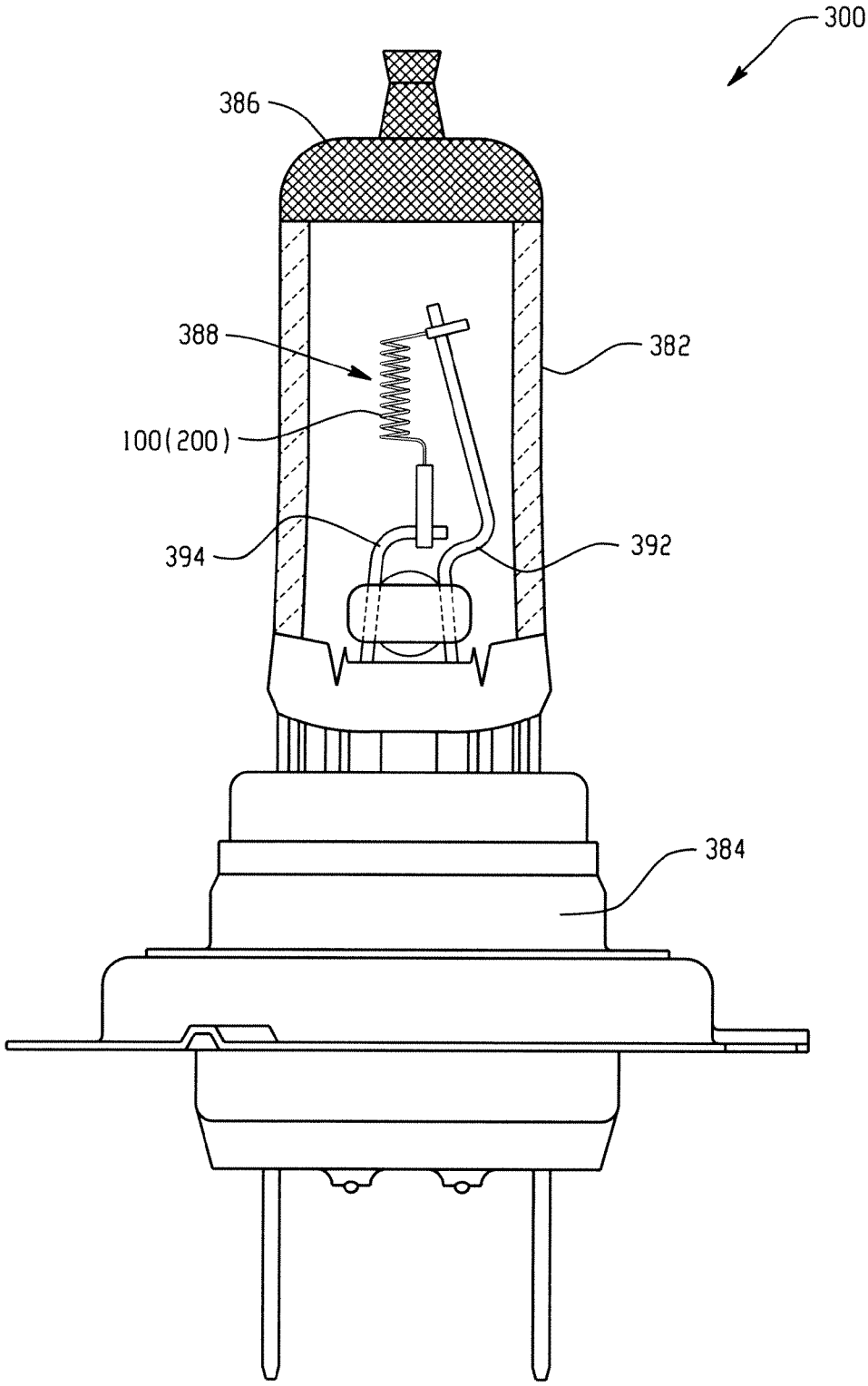
FIG. 3 is a side view of an automotive halogen incandescent lamp.

FIG. 3 illustrates an incandescent lamp such as an automobile lamp 300. The automotive lamp 300 is a halogen incandescent lamp with an envelope or outer bulb 382 fixed on a base 384. The envelope 382 is formed from a light transmissive material and often includes a darkened region 386 to limit glare light from the headlamp. The envelope 382 encloses a filament structure 388 which may be one of the filament structures 100 or 200 as shown and described in connection with the exemplary embodiment. The filament structure is mechanically and electrically connected to lead wires 392, 394, for example, by being welded thereto so that long lifetime and reliable operation of the lamp 300 is facilitated. It is to be appreciated, that such lamps, e.g., halogen incandescent lamps used for as the lamps of automobiles, are well known to a person skilled in the art and need no further description to a full and complete understanding of the present disclosure.

The disclosure has been described with reference to the preferred embodiments. Obviously, modifications and alterations will occur to others upon reading and understanding the preceding detailed description. It is intended that the disclosure be construed as including all such modifications and alterations.

Having thus described the invention, it is now claimed:

1. A filament coil for an incandescent lamp assembly comprising:

a helical winding extending generally along a longitudinal axis between a first end and a second end, the winding having a first pitch ratio at the first and second ends, and a different, second pitch ratio along an intermediate portion located between the first and second ends wherein the first pitch ratio is approximately between 45 turns per inch (tpi) and 70 tpi.

2. The filament coil of claim 1, wherein the first helical pitch is less (less turns per inch (tpi)) than the second helical pitch.

3. The filament coil of claim 2, wherein the coil has substantially the same diameter at the first and second ends.

4. The filament coil of claim 3, wherein the coil has substantially the same diameter along the intermediate portion as the first and second ends.

5. The filament coil of claim 4, wherein the first helical pitch is approximately 60 turns per inch (tpi).

6. The filament coil of claim 5, wherein the second helical pitch is approximately 100 tpi.

7. The filament coil of claim 1, wherein first and second filament sections are of different diameters.

8. The filament coil of claim 7, wherein the first diameter is greater than the second diameter.

9. The filament coil of claim 8, wherein the intermediate portion has a substantially constant diameter.

10. The filament coil of claim 8, wherein the diameters of the first and second ends gradually increase as the coil proceeds along the longitudinal axis from the intermediate portion.

11. The filament coil of claim 1, wherein the first end, second end, and intermediate portion each define about one-third of a total length of the coil along the longitudinal axis.

12. A method of forming a filament coil for an incandescent lamp comprising:

supplying a helical winding having an intermediate portion located between first and second ends along a longitudinal axis;

providing a first pitch ratio at the first and second ends; and providing a different second pitch ratio at the intermediate portion wherein the second pitch ratio is approximately between 50 turns per inch (tpi) and 100 tpi.

13. The method of claim 12, wherein the pitch ratio providing steps include forming the first helical pitch (turns per inch) less than the second helical pitch.

14. The method of claim 12, further comprising maintaining a substantially constant diameter along the first and second ends and the intermediate portion.

15. The method of claim 12, wherein the pitch ratio providing steps include providing a first diameter at the first and second ends different from a diameter of the intermediate portion.

16. The method of claim 15, wherein the first diameter is greater than the second diameter.

17. The method of claim 12, wherein the pitch ratio providing steps at the first and second ends, and intermediate portion are substantially equally divided along the length of the coil.

* * * * *